US009611748B2

(12) United States Patent
Kington et al.

(10) Patent No.: US 9,611,748 B2
(45) Date of Patent: Apr. 4, 2017

(54) STATIONARY AIRFOILS CONFIGURED TO FORM IMPROVED SLIP JOINTS IN BI-CAST TURBINE ENGINE COMPONENTS AND THE TURBINE ENGINE COMPONENTS INCLUDING THE SAME

(71) Applicant: HONEYWELL INTERNATIONAL INC., Morristown, NJ (US)

(72) Inventors: Harry Lester Kington, Scottsdale, AZ (US); Shezan Kanjiyani, Glendale, AZ (US); Natalie Wali, Chandler, AZ (US); John Gintert, Tempe, AZ (US); Bradley R. Tucker, Chandler, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 587 days.

(21) Appl. No.: 14/099,218

(22) Filed: Dec. 6, 2013

(65) Prior Publication Data

US 2015/0159495 A1 Jun. 11, 2015

(51) Int. Cl.

| | |
|---|---|
| ***F01D 25/26*** | (2006.01) |
| ***F01D 9/04*** | (2006.01) |
| ***B22C 9/04*** | (2006.01) |
| ***B22C 9/22*** | (2006.01) |

(52) U.S. Cl.

CPC ..... *F01D 9/042* (2013.01); *B22C 9/04* (2013.01); *B22C 9/22* (2013.01); *F01D 9/041* (2013.01); *F01D 25/26* (2013.01); *F05D 2230/21* (2013.01); *F05D 2300/50212* (2013.01)

(58) Field of Classification Search

CPC ..... F01D 9/041; F01D 9/042; F01D 9/044; F01D 25/26; F05D 2230/21; F05D 2300/5021; F05D 2300/50211; F05D 2300/50212; B22C 9/04; B22C 9/22

USPC ..... 415/135, 137, 138, 139, 191, 209.3, 415/209.4, 210.1, 915; 164/35, 45

See application file for complete search history.

(56) References Cited

U.S. PATENT DOCUMENTS

| | | | |
|---|---|---|---|
| 2,332,330 | A | 10/1943 | McMahan |
| 3,824,030 | A | 7/1974 | DeFeo |
| 4,728,258 | A | 3/1988 | Blazek et al. |

(Continued)

FOREIGN PATENT DOCUMENTS

| | | |
|---|---|---|
| GB | 1487156 | 9/1977 |

OTHER PUBLICATIONS

EP Extended Search Report for EP 14185038.8-1610 dated Apr. 23, 2015.

(Continued)

*Primary Examiner* — Christopher Verdier
(74) *Attorney, Agent, or Firm* — Lorenz & Kopf, LLP

(57) ABSTRACT

Stationary airfoils configured to form an improved slip joint in bi-cast turbine engine components and the turbine engine components including the same are provided. The stationary airfoil for a bi-cast turbine engine component comprises a leading edge and a trailing edge interconnected by a pressure sidewall and a suction sidewall. An end portion is shaped with a pair of opposing flanges to form a slip joint with a shroud ring in the bi-cast turbine engine component and to define an interlocking feature. The slip joint permits radial movement of the stationary airfoil relative to the shroud ring due to thermal differential expansion and contraction.

17 Claims, 9 Drawing Sheets

(56) References Cited

U.S. PATENT DOCUMENTS

| | | | | |
|---|---|---|---|---|
| 4,955,423 | A | 9/1990 | Blazek | |
| 4,987,944 | A | 1/1991 | Parks | |
| 5,069,265 | A | 12/1991 | Blazek | |
| 5,290,143 | A | 3/1994 | Kington et al. | |
| 5,318,406 | A | 6/1994 | Bardes | |
| 6,164,912 | A | 12/2000 | Tabbita et al. | |
| 6,386,827 | B2 | 5/2002 | Yu et al. | |
| 6,409,473 | B1 | 6/2002 | Chen et al. | |
| 7,303,375 | B2 | 12/2007 | Cunha et al. | |
| 2011/0243724 | A1 | 10/2011 | Campbell et al. | |
| 2011/0297344 | A1 | 12/2011 | Campbell et al. | |
| 2012/0163979 | A1 | 6/2012 | Darkins, Jr. et al. | |
| 2014/0169957 | A1* | 6/2014 | Kanjiyani | F01D 1/04 415/202 |

OTHER PUBLICATIONS

Calvert, G. S. et al.: "Cooled radial turbine for high power-to-weight applications" Journal of Aircraft, vol. 7, No. 4 (1970), pp. 348-354.

* cited by examiner

STATIONARY AIRFOILS CONFIGURED TO FORM IMPROVED SLIP JOINTS IN BI-CAST TURBINE ENGINE COMPONENTS AND THE TURBINE ENGINE COMPONENTS INCLUDING THE SAME

STATEMENT REGARDING FEDERALLY SPONSORED RESEARCH OR DEVELOPMENT

This invention was made with Government support under W911W6-08-2-0001 awarded the U.S. Army. The Government has certain rights in the invention.

TECHNICAL FIELD

The present invention generally relates to gas turbine engines, and more particularly relates to stationary airfoils configured to form improved slip joints in bi-cast turbine engine components and the turbine engine components including the same.

BACKGROUND

Gas turbine engines are generally known in the art and used in a wide range of applications, such as propulsion engines and auxiliary power unit engines for aircraft. In a typical configuration, a turbine section of the gas turbine engine includes a turbine engine component such as a turbine nozzle, etc. A turbine engine component comprises an annular array of stationary airfoils (i.e., vanes or simply "airfoils") that extend between shroud rings. In the gas turbine engine, hot gases from the combustion chamber are directed against the annular array of airfoils. During transient conditions, such as start-up and shut down of the gas turbine engine, the combustion gas temperature rapidly changes. As the airfoils (relative to the shroud rings) are more exposed to the hot combustion gas, the airfoils respond more quickly to the changes in gas temperature. Thus, when the airfoils are heated faster or hotter than the shroud rings, the airfoils become susceptible to large thermal compressive stresses because the airfoils tend to expand but are constrained by the shroud rings. Similarly, when cooled, a large tensile stress is created across the airfoils that tend to induce contraction.

The cyclic nature of the thermal stresses render the airfoils highly susceptible to low cycle fatigue cracking. Moreover, the differences (if any) between the coefficients of thermal expansion of the airfoil material and the shroud ring material may also cause thermal stresses. Therefore, a conventional bi-cast turbine engine component includes slip joints between an end portion of each airfoil in the annular array and an adjacent shroud ring, in order to accommodate thermal expansion of the airfoils. FIGS. 1 and 2 depict a single airfoil in a portion of the conventional bi-cast turbine engine component. An end portion 36 of the airfoil 24 is slip coupled to an adjacent shroud ring 28 by a slip joint 58. The conventional slip joint 58 is formed by the generally convex sloping side surfaces 66 and 68 of the end portion 36. An opposing end portion 32 of the airfoil is anchored by the opposing shroud ring 26. During operation of the gas turbine engine, when the shroud rings 26 and 28 and airfoils 24 are at the same ambient temperature, the slip joints 58 are closed, in the manner illustrated schematically in FIG. 1. However, when the airfoils 24 are heated to a temperature that is above the temperature of the shroud rings 26 and 28, the airfoils expand radially outwardly relative to the shroud rings. There will be greater thermal expansion of the airfoils

24 relative to the shroud rings. As this occurs, the slip joints 58 open, as shown schematically in FIG. 2. As the slip joints 58 open, the airfoil will expand into a space 164 in the adjacent shroud ring 28. The space is formed in the shroud ring during bi-casting of the turbine engine component (resulting in the bi-cast turbine engine component) as hereinafter described.

The bi-cast method of manufacturing a bi-cast turbine engine component is well known in the art. Generally, when the bi-cast turbine engine component is manufactured, the shroud rings are cast after the airfoils have been individually cast and placed in the annular array of an assembly fixture. Core material is disposed at the end portion of the airfoils and is used to form the slip joints between the end portion of each airfoil in the annular array and the adjacent shroud ring. The airfoil and core material are connected by an adhesive bond. The airfoils are positioned in the annular array with the end portion and opposing end portion of the airfoils at least partially enclosed by a shroud ring pattern comprised of a wax material. The exposed surfaces of the airfoils and the shroud ring patterns are covered with ceramic mold material. After the exposed areas of the airfoil and the shroud ring patterns have been covered with ceramic mold material to make a mold, the shroud ring patterns are removed (by melting of the wax material) to leave shroud ring mold cavities, with the core material enclosed in a shroud ring mold cavity. Once the mold has been formed in this manner, the mold is preheated to about 1800° F. The shroud ring mold cavities are filled with molten metal that is then solidified to form the shroud rings. After the molten metal has solidified, the core material is removed from the shroud ring adjacent the end portion to leave the space around the end portion for thermal expansion of the airfoil relative to the shroud ring.

The airfoil material and core material typically have different coefficients of thermal expansion causing thermal stress during manufacture of the conventional bi-cast turbine engine component (more particularly, during the melting and preheating steps), and the adhesive bond between the core material and the end portion of the airfoils may be broken. More specifically, the core material develops cracks as a result of the thermal expansion mismatch and may separate from the end portion of the airfoils. Therefore, when the shroud ring mold cavity adjacent the end portion is filled with molten metal, the molten metal may fill in the space formerly occupied by the now-separated core material, thereby eliminating the slip joint between the airfoil and the shroud ring. Even if the adhesive bond is not broken and the slip joints are successfully formed, the conventional slip joint accommodates thermal expansion of the airfoils, but not thermal contraction of the airfoils that occurs when the shroud rings are hotter than the airfoils. Therefore, large thermally induced loads in the airfoils and inner and outer shroud rings may result.

Accordingly, it is desirable to provide airfoils configured to form improved slip joints in bi-cast turbine engine components and the turbine engine components including the same. It is also desirable to configure the airfoils such that the airfoils can thermally expand and contract during engine operation. Furthermore, other desirable features and characteristics of the present invention will become apparent from the subsequent detailed description of the present invention and the appended claims, taken in conjunction with the accompanying drawings and this background of the invention.

BRIEF SUMMARY

A stationary airfoil for a bi-cast turbine engine component is provided. In accordance with one exemplary embodiment, the stationary airfoil comprises a leading edge and a trailing edge interconnected by a pressure sidewall and a suction sidewall. An end portion is shaped with a pair of opposing flanges to form a slip joint with a shroud ring in the bi-cast turbine engine component and to define an interlocking feature. The slip joint permits radial movement of the stationary airfoil relative to the shroud ring due to thermal differential expansion and contraction.

A turbine engine component is provided in accordance with another exemplary embodiment of the present invention. The turbine engine component comprises a shroud ring and a stationary airfoil coupled to the shroud ring. The stationary airfoil comprises a leading edge and a trailing edge interconnected by a pressure sidewall and a suction sidewall. An end portion of the stationary airfoil forms a slip joint with the shroud ring. The slip joint permits radial movement of the airfoil relative to the shroud ring. The end portion is shaped to include a pair of opposing flanges to define the slip joint.

A bi-cast turbine engine component is provided in accordance with yet another exemplary embodiment of the present invention. The bi-cast turbine engine component comprises an outer shroud ring and an inner shroud ring circumscribed by the outer shroud ring and spaced therefrom to define a portion of a flow path in a gas turbine engine. A plurality of stationary airfoils is disposed in an annular array between the outer and inner shroud rings and is configured to be disposed in the portion of the flow path. Each stationary airfoil comprises a leading edge and a trailing edge interconnected by a pressure sidewall and a suction sidewall and an end portion. The end portion forms a slip joint with a shroud ring comprising one of the outer or inner shroud rings. The end portion is disposed in a space in the shroud ring adjacent to the end portion of the airfoil and is shaped with a pair of opposing flanges. Each stationary airfoil moves radially relative to the shroud ring due to thermal differential expansion and contraction.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various embodiments are directed to stationary airfoils configured to form an improved slip joint in bi-cast turbine engine components. Each stationary airfoil (i.e., vane or simply "airfoil") is configured with an end portion shaped to form the improved slip joint during bi-casting of the turbine engine component. The improved slip joint accommodates airfoil thermal expansion and contraction during engine operation. During manufacturing of the bi-cast turbine engine component, a mechanical interlock between a core material and the end portion of the airfoil (each airfoil) is formed and remains intact until the core material is removed, thereby permitting formation of the improved slip joint.

Figure 3:
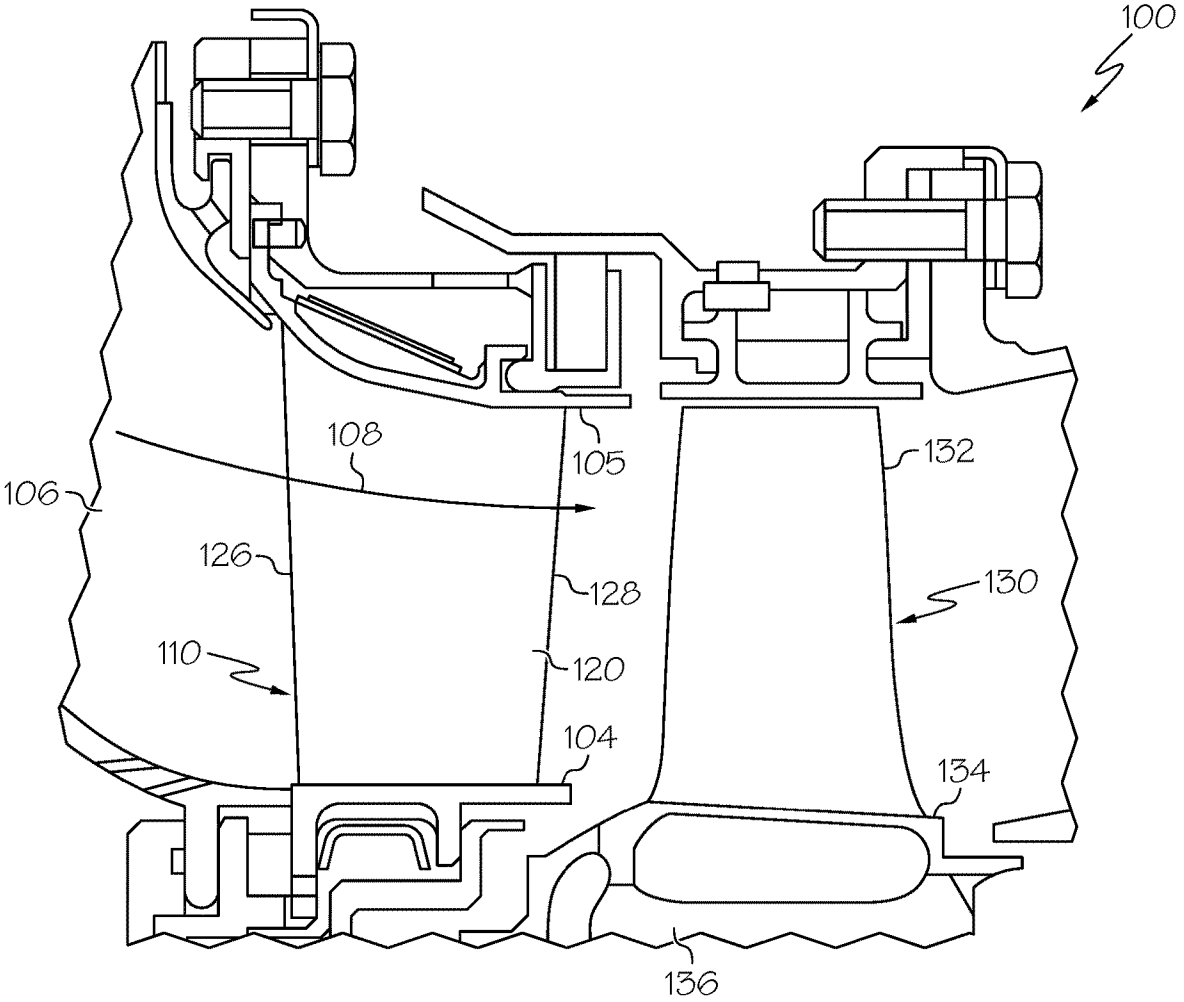
FIG. 3 is a partial cross-sectional view of a turbine section of an exemplary gas turbine engine (not shown in FIG. 3)

FIG. 3 is a fragmented partial cross sectional view illustrating a partial high pressure turbine (HPT) section 100 of a gas turbine engine in accordance with an exemplary embodiment. The turbine section 100 and gas turbine engine have an overall construction and operation that is conventional. In general terms, the turbine section 100 has at least one turbine nozzle 110 with stationary airfoils (vanes) 120 and at least one turbine rotor 130 with rotor blades 132 (rotating airfoils). The stationary airfoils of the turbine nozzle 110 extend between annular shroud rings 104 and 105 that define a mainstream hot gas flow path 106 for receiving a flow of mainstream combustion gases 108 from an engine combustor (not shown). The rotor blades 132 of the turbine rotor 130 project radially outward from a turbine rotor platform 134 that is coupled to a turbine disk 136, which in turn circumscribes a shaft (not shown). During operation, the combustion gases 108 flow past axially spaced circumferential rows of the stationary airfoils (vanes) 120 and rotor blades 132 to drive the rotor blades 132 and the associated turbine rotor 130 for power extraction. Other embodiments may be differently arranged.

Figure 1:
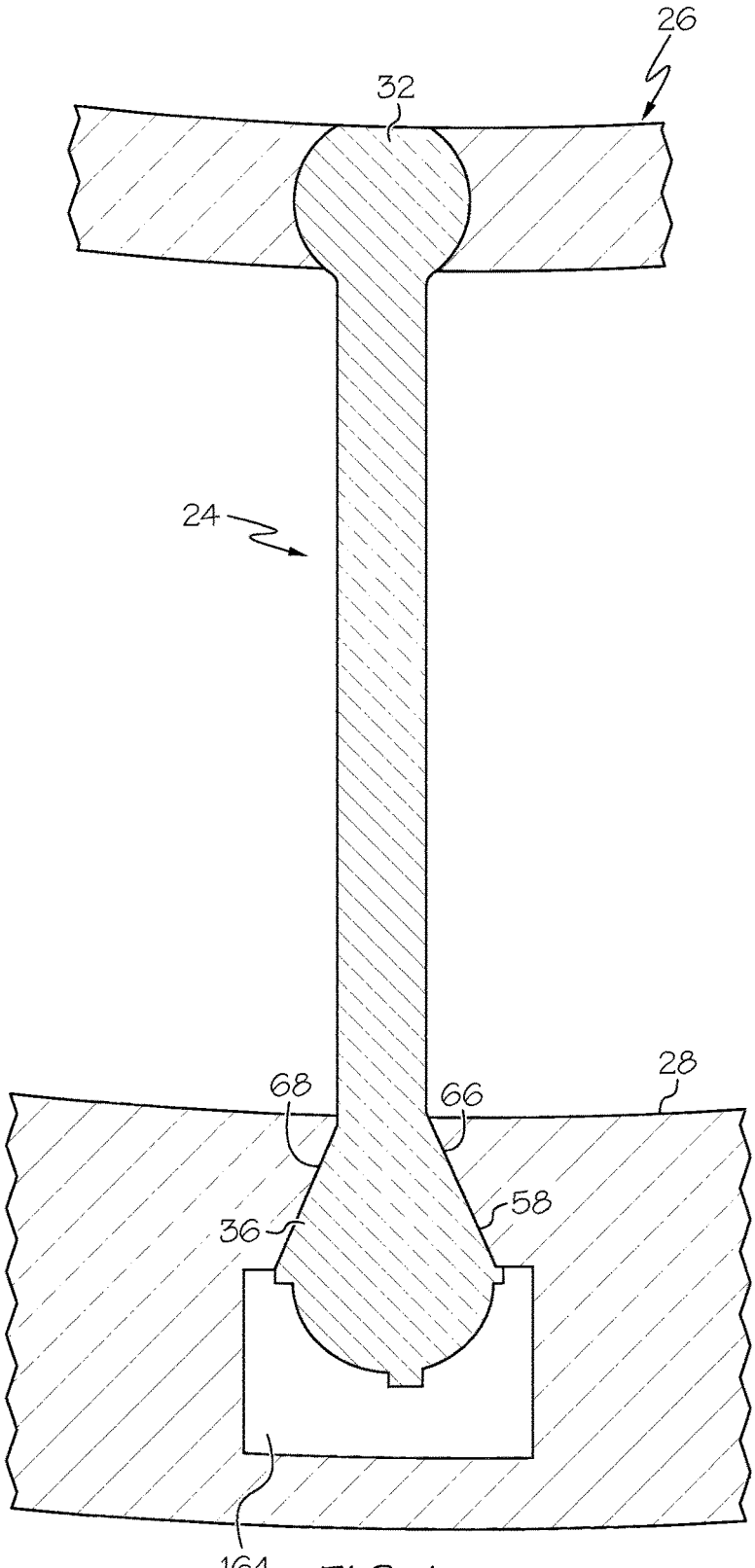
FIG. 1 (PRIOR ART)
FIG. 1 is a fragmentary sectional view of a portion of a conventional bi-cast turbine engine component illustrating an airfoil having an end portion that includes a conventional slip joint in a closed condition, the slip joint slip coupling the end portion to an adjacent shroud ring and an opposing end portion anchored to an opposing shroud ring.
Figure 2:
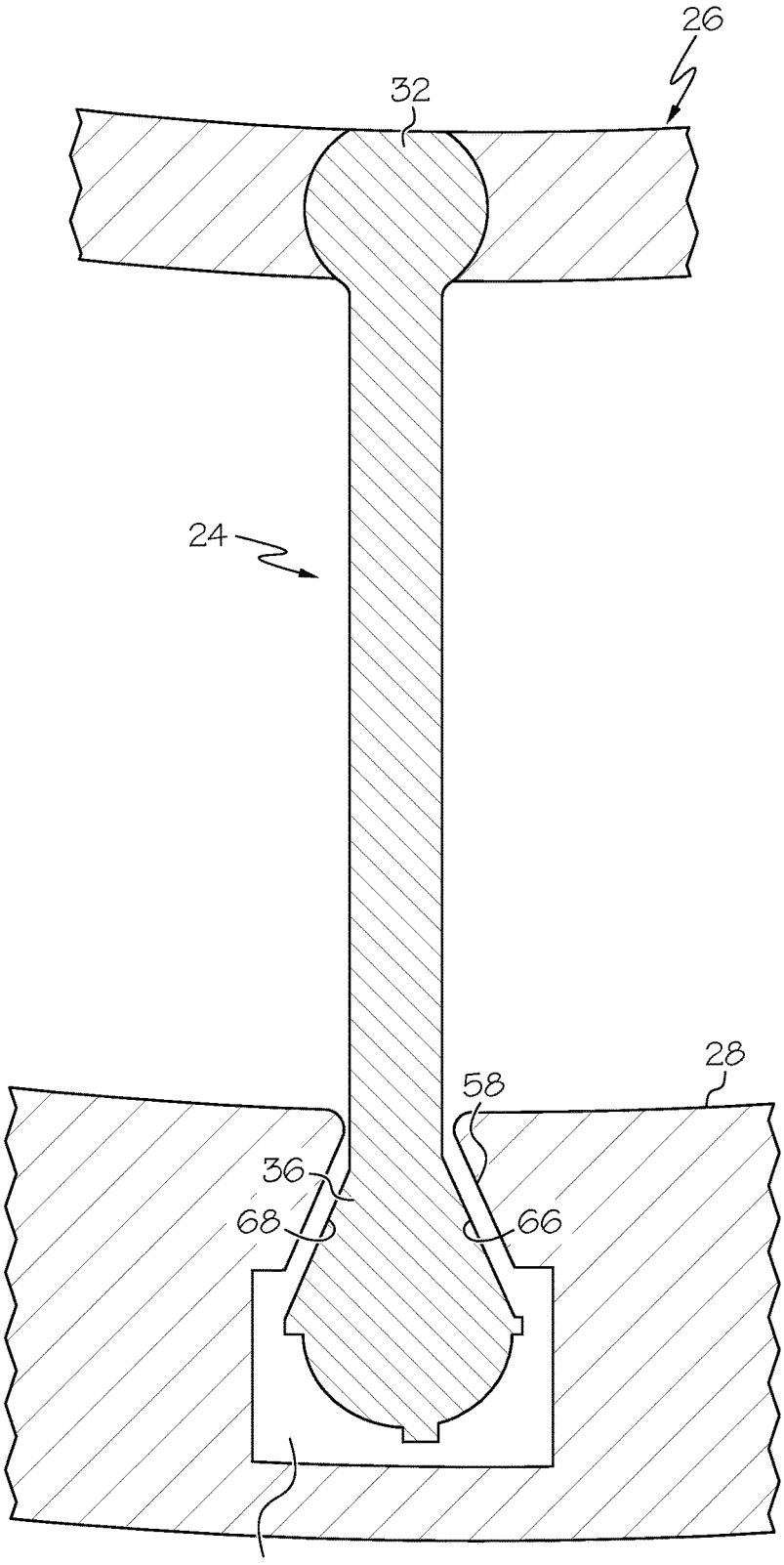
FIG. 2 (PRIOR ART)
FIG. 2 is a fragmentary sectional view similar to FIG. 1, depicting the conventional slip joint of FIG. 1 in an open condition.
Figure 4:
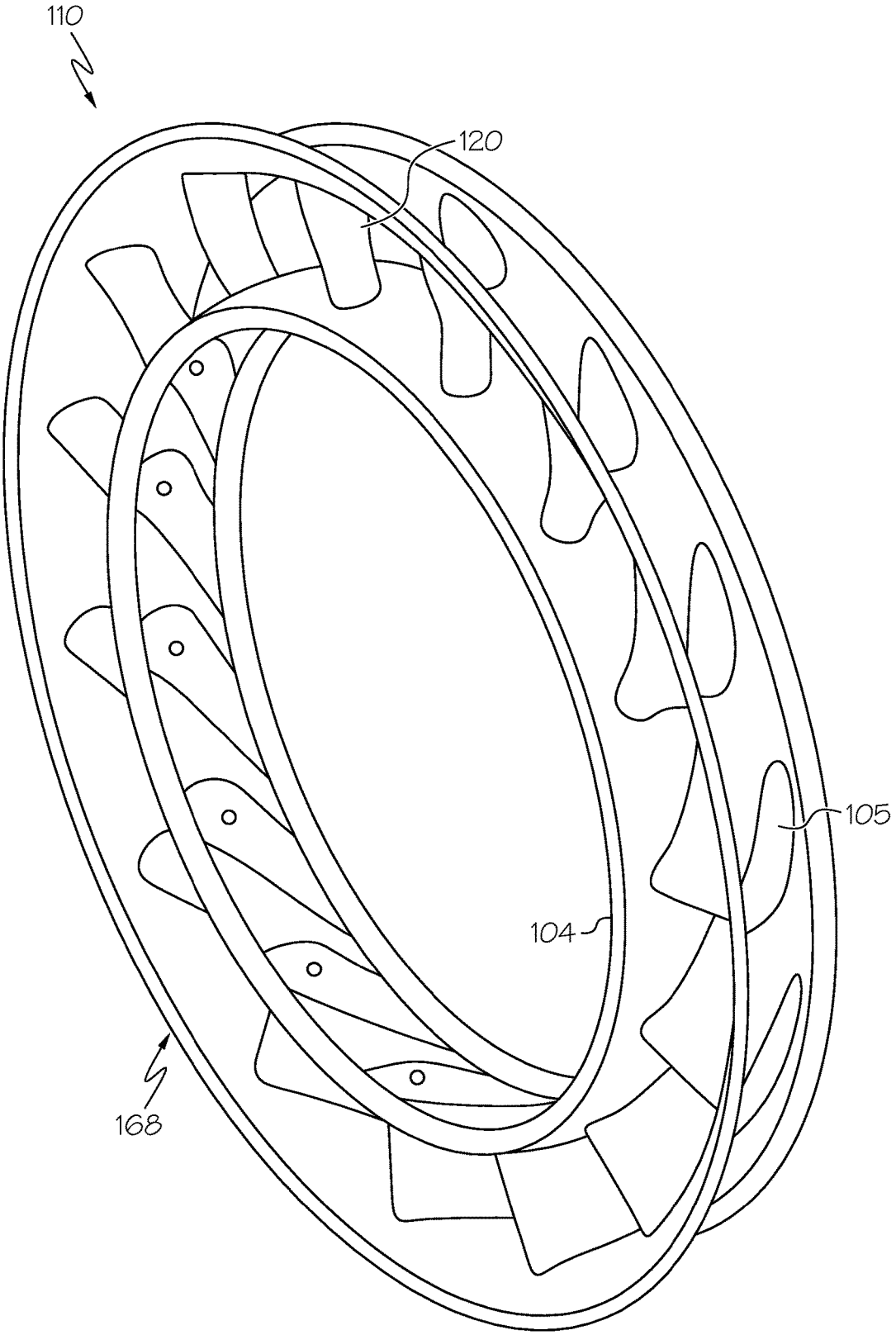
FIG. 4 is an isometric view of an exemplary turbine engine component (a bi-cast turbine nozzle) according to exemplary embodiments.
Figure 5:
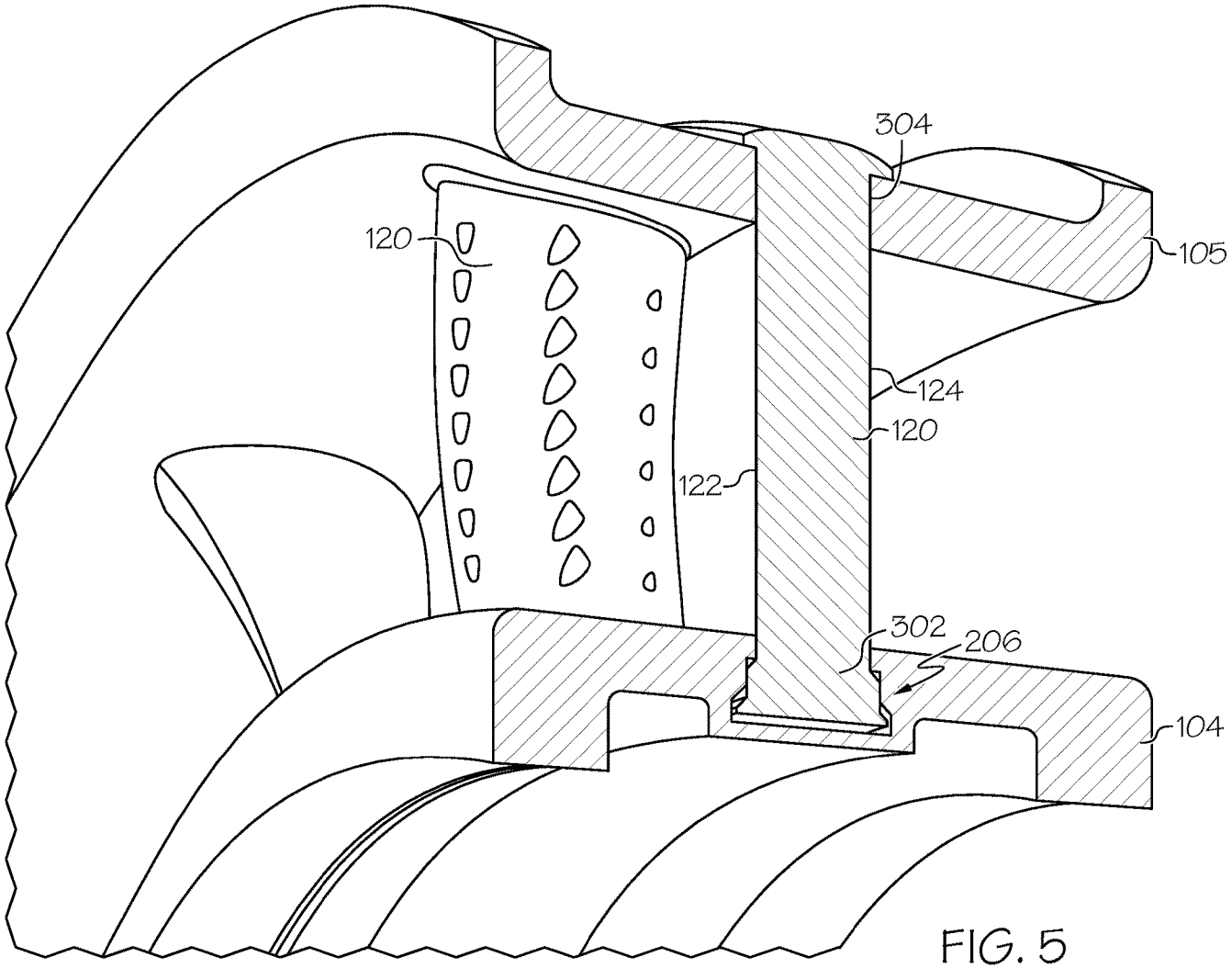
FIG. 5 is a schematic view of a portion of the bi-cast turbine nozzle of FIG. 4, the bi-cast turbine nozzle comprising an outer endwall, an inner endwall circumscribed by the outer endwall and spaced therefrom to define a portion of a combustion gas flow path in the gas turbine engine (not shown in FIG. 4), and a plurality of stationary airfoils (vanes) (only two are illustrated) disposed in an annular array between the outer and inner endwalls, each vane having an inner end portion forming a slip joint with the (adjacent) inner endwall, the inner end portion disposed in a space in the inner endwall and the outer end portion anchored in the outer endwall.

FIG. 4 is an isometric view of an exemplary bi-cast turbine nozzle 110 in accordance with an exemplary embodiment that may be incorporated into the turbine section 100 of FIG. 1. FIG. 5 is a schematic view of a portion of the bi-cast turbine nozzle of FIG. 4. The turbine engine component, such as the bi-cast turbine nozzle of FIGS. 4 and 5, comprises a plurality of stationary airfoils 120 (i.e., vanes) arranged in the annular array between the inner and outer shroud rings 104 and 105. In the illustrated embodiment of the present invention, the inner and outer shroud rings 104 and 105 are positioned in a concentric relationship with the airfoils 120 disposed in a radially extending annular array between the shroud rings. The bi-cast turbine nozzle will be fixedly mounted between the combustion chamber and first stage rotor of the gas turbine engine. The hot gases from the combustion chamber are directed against the annular array of stationary airfoils 120 that extend between the inner shroud ring 104 and the outer shroud ring 105.

Although it is believed that the turbine nozzle 110 constructed in accordance with the present invention will be particularly advantageous when used between the combustion chamber and first stage rotor of a turbine engine, it should be understood that turbine engine components constructed in accordance with the present invention can be used at other locations in a gas turbine engine. Moreover, while the advantages of the present invention as described herein will be described with reference to the bi-cast turbine nozzle as shown in FIGS. 4 and 5, the teachings of the present invention are generally applicable to any bi-cast turbine engine component comprising a plurality of stationary airfoils arranged in an annular array between inner and outer shroud rings. Exemplary turbine engine components include, but are not limited to, turbine nozzles, exit guide vanes, etc. It is also to be understood that while a bi-cast turbine nozzle is described, the teachings of the present invention are also generally applicable to a segmented turbine nozzle assembly or a unitary full shroud ring turbine nozzle.

As noted above, the turbine engine component may be manufactured by a known bi-cast method and therefore may be referred to herein as a "bi-cast turbine engine component"). An advantage to the bi-cast method is that the airfoils 120 and shroud rings 104 and 105 can each be formed from materials having different material compositions and crystallographic structures. The airfoils 120 are cast separately from the inner and outer shroud rings 104 and 105. Shroud rings may be respectively cast around inner and outer end portions 302 and 304 of the prefabricated airfoils 120. More particularly, each of the airfoils 120 has a generally concave pressure sidewall 122 and a generally convex suction sidewall 124 opposed thereto. The sidewalls 122 and 124 (FIG. 5) interconnect a leading or upstream edge 126 and a trailing or downstream edge 128 (FIG. 3). Each airfoil comprises an inner end portion 302 that is coupled to the inner shroud ring 104 and an outer end portion 304 that is coupled to the outer shroud ring 105. One of the inner end portion 302 or the outer end portion 304 of each airfoil is slip coupled by a slip joint 206 with the adjacent shroud ring, as known in the art. The opposing end portion is anchored to the opposing shroud ring.

The airfoils 120 may be formed of metal that can withstand the extremely high operating temperatures (greater than about 2000° Fahrenheit) to which they are exposed in the gas turbine engine. The airfoil material is advantageously ductile to be deformable at such operating temperatures, for purposes as hereinafter described. For example, the airfoils 120 may be cast as a single crystal of a nickel-chrome alloy metal. The airfoils may be cast by methods well known in the art. As the shroud rings 104 and 105 are subjected to operating temperatures that differ somewhat from the operating temperatures to which the airfoils 120 are subjected, the shroud rings 104 and 105 can advantageously be made of materials which are different from the materials of the airfoils as hereinafter described. For example, the inner and outer shroud rings 104 and 105 may be formed of a nickel chrome or cobalt chrome superalloy, such as MAR M509. Although the shroud rings 104 and 105 are described as cast of the same metal, they could be formed of different metals, if desired. Therefore, it is to be understood that the inner shroud ring 104 may be cast of one metal and the outer shroud ring 105 cast of another metal. The airfoils 120 may be formed of a third metal in order to optimize the operating characteristics of the bi-cast turbine nozzle 110. The shroud rings 104 and 105 have a generally cylindrical main or body section 168 (FIG. 4). In another embodiment, the shroud rings and airfoils may comprise the same material.

Figure 6:
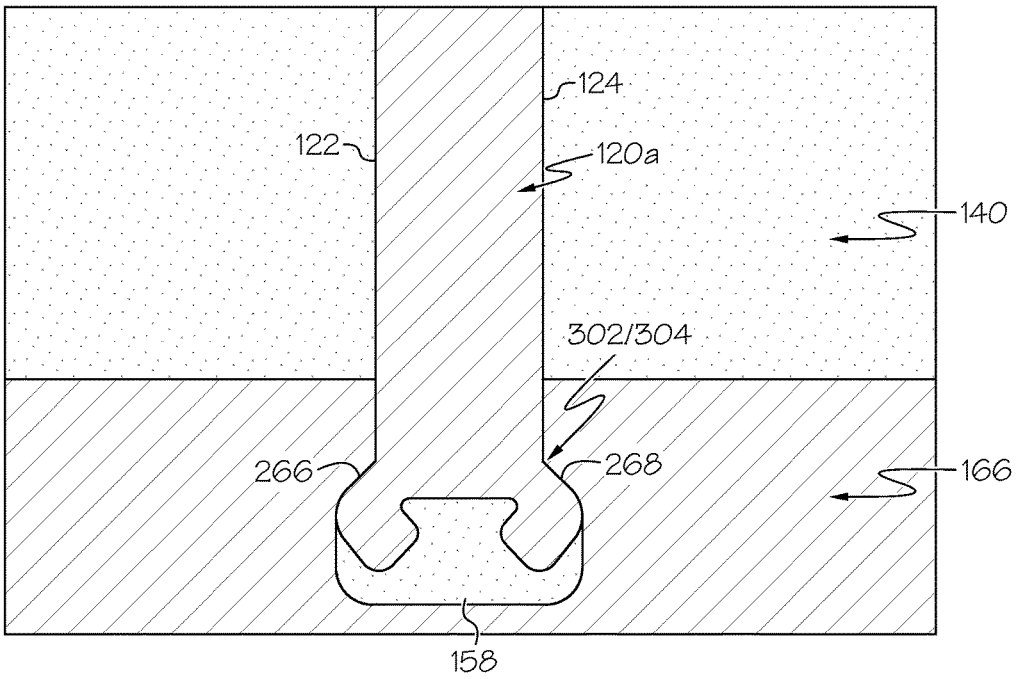
FIG. 6 depicts in simplified form an end portion of a stationary airfoil of the bi-cast turbine nozzle of FIGS. 4 and 5, a core material disposed at the end portion and the end portion and core material embedded in a wax shroud ring pattern, the end portion including an interlocking feature (the opposing flanges) and a ceramic mold material encasing the wax shroud ring pattern and the exposed areas of the stationary airfoil, according to exemplary embodiments.
Figure 7:
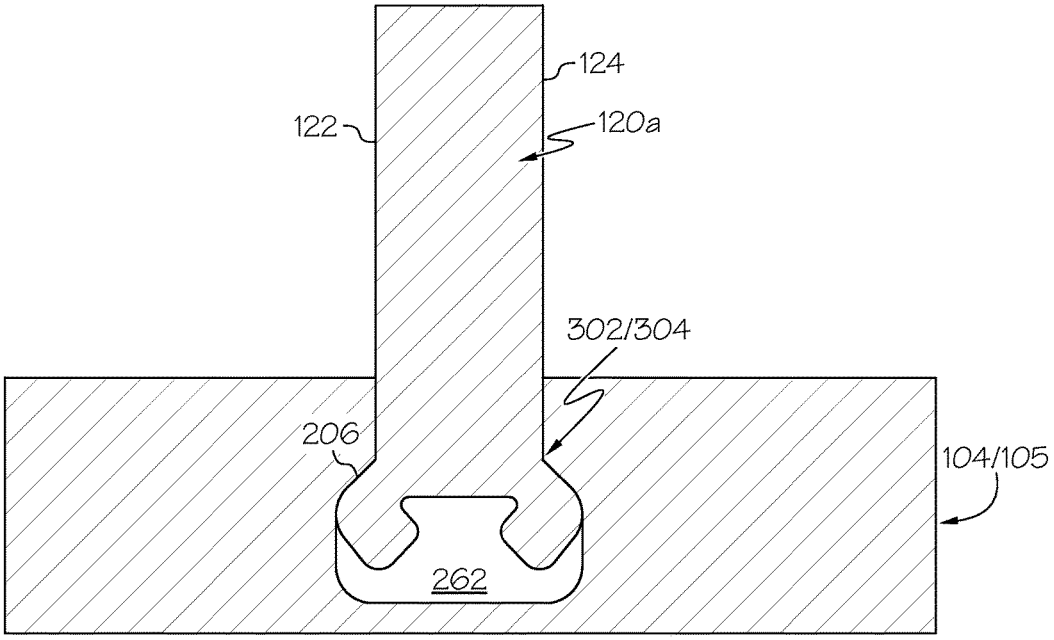
FIG. 7 depicts in simplified form the end portion of the airfoil of FIG. 6 slip coupled with a shroud ring by a slip joint in accordance with exemplary embodiments, the shroud ring formed by removing the wax shroud ring pattern and mold material of FIG. 6, the airfoil end portion disposed in a space in the shroud ring formed by removal of the core material and the slip joint in a closed condition.
Figure 8A:
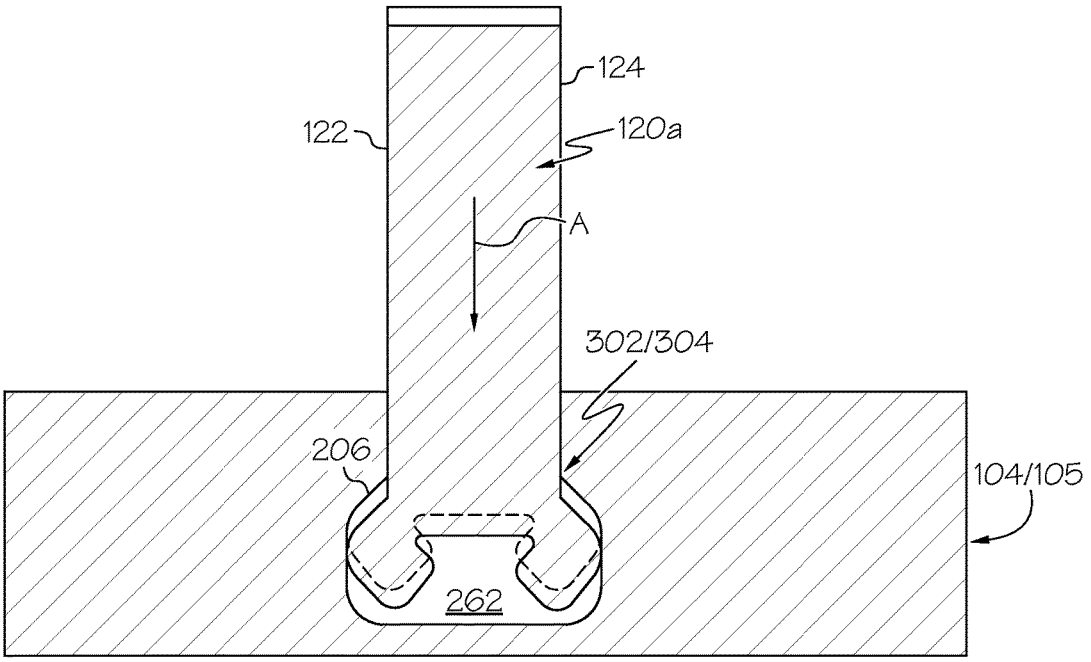
FIGS. 8A and 8B depict in simplified form the end portion of the airfoil of FIGS. 6 and 7 slip coupled with the shroud ring, the airfoil end portion radially moving into the space in the shroud ring (FIG. 8A) and contracting out of the space in the shroud ring as the opposing flanges inwardly deform (FIG. 8B), the airfoil moving radially relative to the shroud ring due to thermal differential expansion and contraction and the slip joint in an open condition.
Figure 8B:
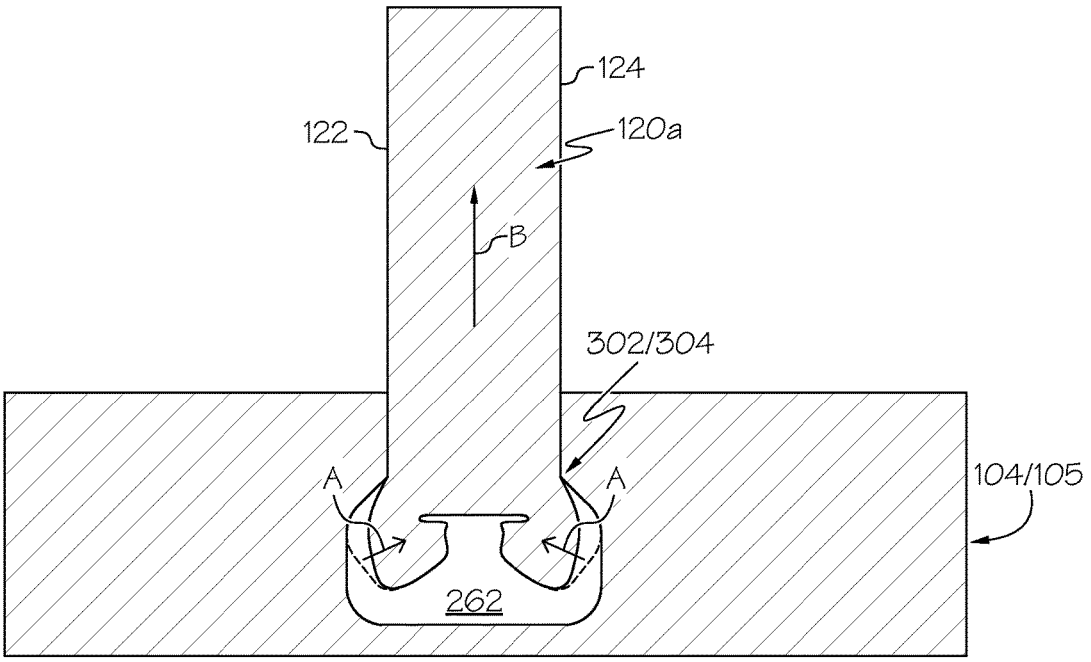

Referring now to FIGS. 5 through 11, according to exemplary embodiments of the present invention, the end portion of the airfoil that is slip coupled to the adjacent shroud ring is shaped to form the slip joint 206 with the shroud ring in the bi-cast turbine engine component and to define an interlocking feature. The interlocking feature comprises a pair of opposing flanges that define a terminal end of the end portion. The end portion is shaped with the pair of opposing flanges. The opposing flanges may include a convex surface, a concave surface, or both convex and concave surfaces. Exemplary end portion shapes are depicted in FIGS. 6 through 11. For example, referring specifically to FIG. 5, the inner end portion is shaped to form the slip joint 206 with the inner shroud ring 104 in the bi-cast turbine nozzle. While the slip joint 206 is illustrated in FIG. 5 as between the inner end portion 302 of the airfoils in the annular array and the inner shroud ring 104, it is to be understood that the slip joints can be between the outer shroud ring 105 and the outer end portion 304 of the airfoils, using the inner shroud ring 104 as the attachment shroud ring as hereinafter described. FIGS. 6 through 8 depict the end portion 302/304 comprising a generally C-shaped end portion. The end portion 302 or 304 of airfoil 120a has a pair of sloping curved side surface areas 266 and 268 that first curve radially outwardly from the concave and convex sidewalls 122 and 124 and then curve inwardly to define the opposing flanges and the generally C-shaped end portion. The generally C-shaped end portion forms the slip joint 206 (FIGS. 7 and 8) with the adjacent shroud ring. The outer surface of the opposing flanges slides against side edge portions of an opening in the shroud ring. The curvature of the side portions of the airfoil corresponds generally to the curvature of the inner side edge portions of the adjacent shroud ring to which the airfoil is slip coupled.

Figure 9:
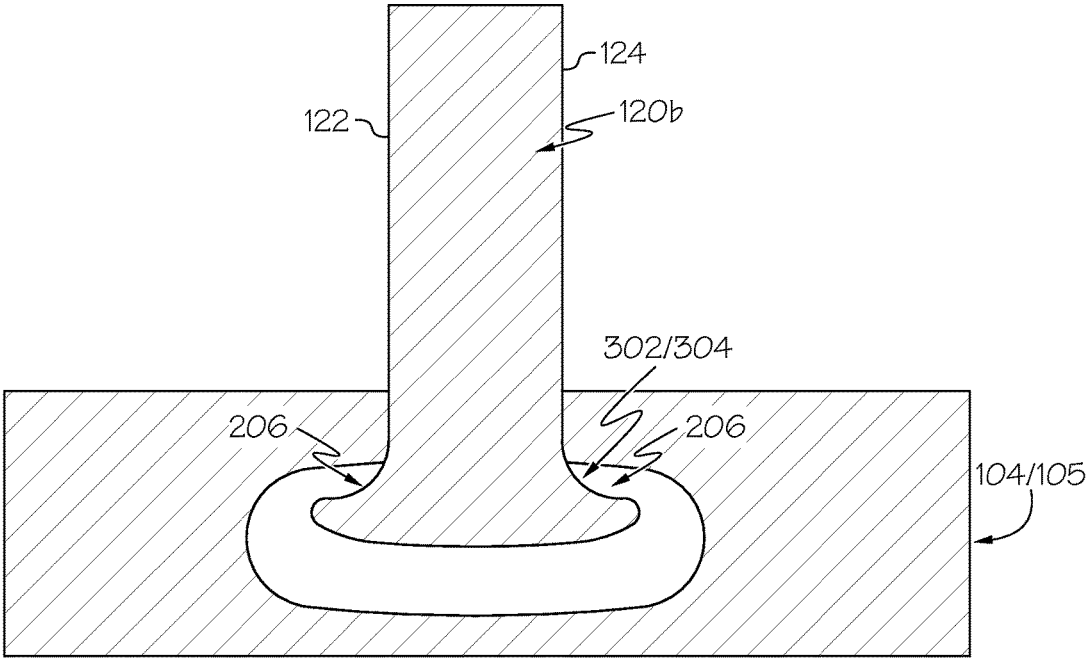
FIGS. 9 through 11 depict an airfoil end portion having alternative shapes in accordance with exemplary embodiments of the present invention and slip coupled with the shroud ring in a turbine engine component (the turbine engine component not shown in FIGS. 9 through 11), with different slip joint geometries depicted in each of FIGS. 9 through 11.
Figure 10:
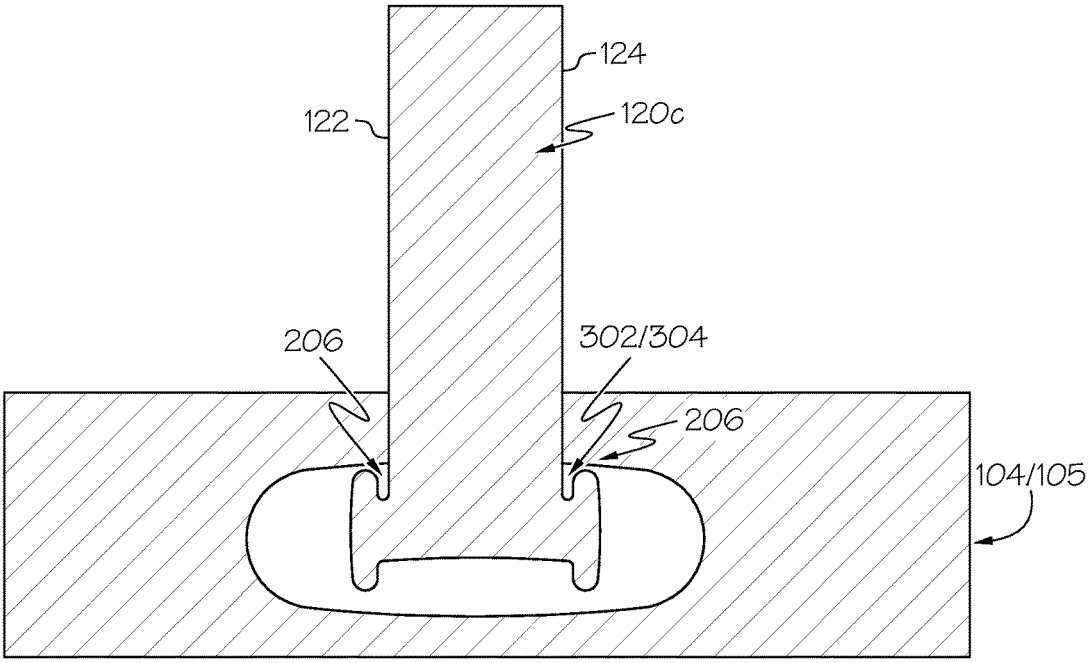
Figure 11:
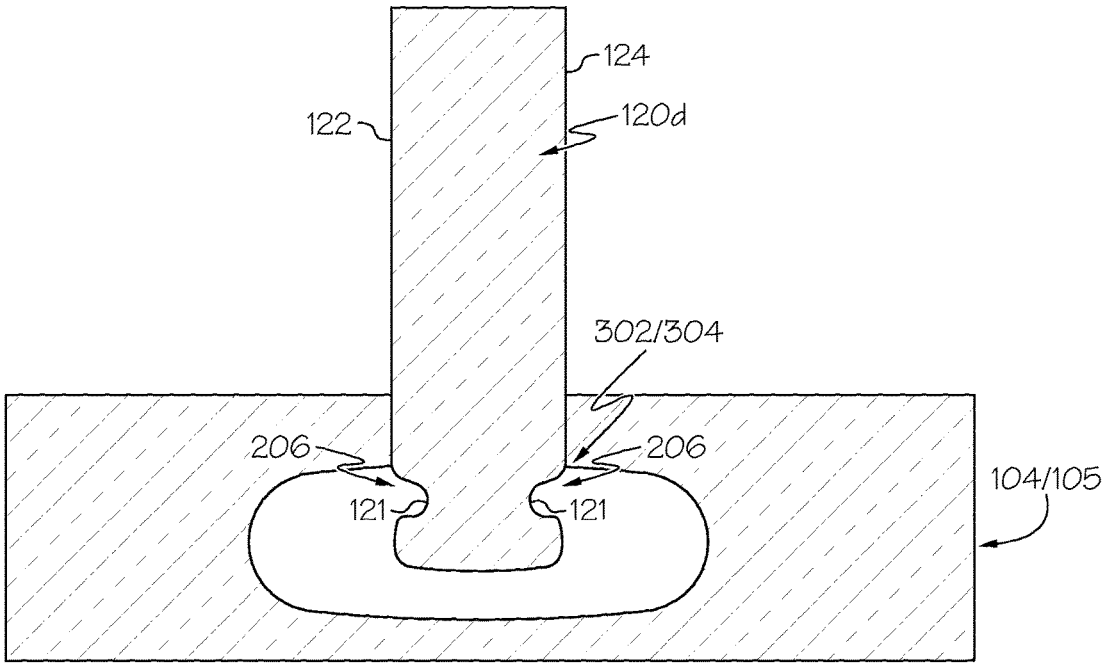

FIG. 9 depicts the end portion 104 or 105 comprising an airfoil 120*b* with an inverted generally T-shaped end portion formed by the pair of opposing flanges. FIG. 10 depicts an airfoil 120*c* with the end portion 302/304 comprising a generally I-shaped end portion. FIG. 11 depicts an airfoil 120*d* with the end portion 302/304 comprising the opposing flanges with both convex and concave (notched) surfaces. Other end portion configurations may be used to define the interlocking feature. Each of the configurations depicted in FIGS. 5 through 11 provide the mechanical interlock with the core material during manufacture of the bi-cast turbine engine component and provide the improved slip joint. It will also be noted that while specific configurations of the end portion 302 or 304 have been illustrated, the end portion may have any configuration suitable for the purpose of providing the improved mechanical interlock with the core material. In addition, the end portion of stationary airfoils 120*b*-120*d* maintains a radial gap to the adjacent surface in the (adjacent) shroud ring to form the slip joint 206.

The interlocking feature helps form a mechanical interlock between the airfoil and a core material used in manufacturing the bi-cast turbine engine component as hereinafter described relative to the conventional mechanical interconnection. As a result, the improved slip joint 206 is formed between each of the airfoils and the adjacent shroud ring. The interlocking feature may be cast during the airfoil casting process, machined after casting the airfoil, or the like, as known to one skilled in the art. The outer and inner end portions of the airfoils may be separately fabricated from an airfoil mid-chord section.

Bi-cast manufacturing methods are well known in the art and therefore will not be described herein in great detail. While the present bi-cast method will be described generally with reference to FIGS. 6 through 8, it is to be understood that the same method may be used for bi-casting the turbine engine component comprising the airfoil of FIGS. 5 and 9 through 11 (the shaped airfoil end portion slip coupled to the adjacent shroud ring is depicted in FIGS. 9 through 11). In general terms, the core material 158 (FIG. 6) is disposed at the end portions of the airfoil. The core material may be preformed to a desired configuration and mechanically interconnected to the end portions of the airfoils by a combination of mechanical interlocking and adhesive bonding, molded in place at the end portions of an airfoil, or coated over the end portions of the airfoils. The core material directly engages the convex and concave surfaces 266 and 268 on the end portions 302 or 304 of the airfoils. The coating of core material may be applied to the convex and concave surfaces on the end portions of the airfoils in many different ways. The core material may be coated over the end portions of the airfoils by applying a coating of core material over the end portions of the airfoils at locations outwardly of the surfaces. For example, the coating of core material may be applied by painting a liquid slurry of core material on the end portions of the airfoils that is, by applying a wet coating with a brushing or swabbing movement. The coating of core material may be painted on the end portions 302 or 304 of the airfoils by spraying. It is also contemplated that a coating of the core material could be applied by dipping the end portion of the airfoils in the liquid slurry of core material or by forming a mold around the end portion of the airfoils and pouring a slurry of core material into the mold. The core material may be, for example, ceramic, or some other material that may be subsequently removed by a chemical removal process, as hereinafter described. The core material may be of any desired one of many known compositions. It should be understood that the specific composition of the core material is not, per se, a feature of the present invention and that any desired core material may be used. As the coating of core material on end portions of the airfoils 120 is dried, mechanical bonds are formed between the coating and the end portions of the airfoils. The coating of core material bonds directly to the end portions of the airfoils 120. These bonds connect the coating of core material to the airfoils. In addition, the interlocking feature grips the core material to provide the improved mechanical interlock between the core material and the end portion.

The core material has a depth, as measured in the radial direction, that is greater than the maximum possible distance through which the airfoil 120 may expand relative to the shroud ring 104/105 during operation of the turbine engine component. The core material has a width, as measured along an axis extending perpendicular to the longitudinal central axis of the airfoil 120, which is greater than or equal to the width of the end portion of the airfoil 120. By providing the core material 158 with a depth (radial direction) that is greater than the maximum possible extent of thermal expansion of the airfoil 120 relative to the shroud ring and a width that is greater than or equal to the width of the end portion of the airfoil, the space 262 (e.g., FIGS. 7 and 8) which is formed by subsequent removal of the core material 158 is large enough to receive the end portion of the airfoil 120 during thermal expansion of the airfoil relative to the shroud ring. If desired, the size of the end portion of the airfoil 120 may be reduced to enable the size of the shroud ring 104/105 (i.e., its thickness) to be reduced.

The thickness of the coating of core material may be 0.030 inches or less, depending upon the extent of expansion of the airfoils 120. The thickness of the coating of core material can be varied by varying the number of layers in a coating of core material applied to the end portions of the airfoils. The specific coating thickness selected will be a function of the anticipated thermal expansion of the airfoils 120 relative to the shroud ring, i.e., the amount of space formed around the airfoil end portions depends upon the expected growth of the airfoils. Therefore, the core geometry and space may differ between turbine engine components depending upon the expected growth of the airfoils. However, with turbine engine components similar to the turbine engine component, it is believed that a coating of 0.030 inches or less will provide adequate expansion space, i.e., in turbine engine components, the space provided by the core material has an extent of 0.030 inches or less outwardly from the ends of the airfoils.

Referring again to FIG. 6, after the coating of core material has dried on the outer end portions of the airfoils, the airfoils 120*a* are positioned in the annular array with the end portions of the airfoils at least partially enclosed by a shroud ring pattern 166 comprising a wax material (an end portion of a single airfoil and shroud ring pattern 166 is depicted in FIG. 6). The wax material may be a natural wax or an artificial wax with properties similar to the natural wax. The shroud ring pattern comprises an inner shroud ring pattern that is used to cast the inner shroud ring and an outer shroud ring pattern that is used to cast the outer shroud ring. The inner end portion of the airfoil 120 is at least partially enclosed in the annular inner shroud ring pattern. Similarly, the outer end portion of each of the airfoils 120 is at least partially enclosed in the annular outer shroud ring pattern. The wax shroud ring patterns are formed by methods well known in the art. Regardless of how the annular shroud ring patterns are formed, the wax material of the shroud ring pattern 166 engages and extends around the end portions 302 or 304 of the airfoils 120 including the core material 158. The wax shroud ring pattern material extends across the exposed outer surfaces of the core material 158 and the end portions 302 or 304 of the airfoils 120.

Still referring to FIG. 6, the exposed surfaces of the airfoils 120 and inner and outer shroud ring patterns (only one shroud ring pattern 166 is shown in FIG. 6) are then covered with ceramic mold material 140 to form a mold (not shown). Ceramic mold materials are well known in the art. In order to form the mold (not shown), the entire pattern assembly is completely covered with a slurry of liquid ceramic mold material. The entire pattern assembly may be covered with the liquid ceramic mold material by repetitively dipping the pattern assembly in the slurry of liquid ceramic mold material. The ceramic mold material solidifies over the exposed surfaces of the airfoils and the wax inner and outer shroud patterns. After the ceramic mold material 40 has dried, or at least partially dried, the mold (not shown) is heated (typically in a steam autoclave) to melt the wax material of the inner and outer shroud ring patterns. The melted wax is poured out of the inner and outer shroud ring patterns through an open end of the combination pour cup and downpole and degreaser is then used to remove any remaining wax, leaving a pair of annular shroud ring mold cavities (not shown in FIG. 6). The shroud ring mold cavities extend respectively around the inner and outer end portions of the airfoils 120. The shroud ring mold cavity configurations correspond to the configuration of the wax pattern assembly. The core material 158 is enclosed in the shroud ring mold cavity.

Once the mold has been formed in the manner previously described, the mold is preheated to about 1800° F. The shroud ring mold cavities are then filled with molten metal. As noted previously, the (molten) metal of the shroud rings to be fabricated may have a material composition that is different than a material composition of the airfoils. While the molten metal is flowing into the shroud ring mold cavities, the airfoils are held against movement relative to each other and to the mold cavities by the ceramic mold material 140 engaging the major side surfaces 122 and 124 of the airfoils. The molten metal does not engage the end portions of the airfoils 120 which are covered by the core material 158.

The molten metal solidifies to form the inner and outer shroud rings 104 and 105 (FIGS. 7 and 8). As the molten metal solidifies, the airfoils 120 act as chills to promote solidification of the molten metal of the shroud rings in a direction which is transverse to the leading and trailing edges 126 and 128 (FIG. 3) of the airfoils 120. During solidification of the molten metal in the shroud ring mold cavities, a metallurgical bond does not form between the inner and outer shroud rings and the end portions of the airfoils 120. This is because the outer surface of the airfoils 120 is covered with an oxide coating that is formed during processing of the airfoils in the atmosphere. This oxide coating prevents the forming of a metallurgical bond between the airfoils 120 and the inner and outer shroud rings 104 and 105. Therefore, there is only the mechanical interconnection between the inner and outer shroud rings 104 and 105 and the end portions 302 and 304 of the airfoils 120.

During the melting and preheating steps, the airfoils 120 expand relative to the core material 158. However, in accordance with exemplary embodiments, this thermal expansion of the airfoils does not break the mechanical interlock between the core material and the end portion of the airfoil, the mechanical interlock remaining intact during bi-casting until removed by a chemical removal process as hereinafter described. The interlocking feature (i.e., the opposing and deformable flanges) at the airfoil end portion grips and compresses the core material, forming the mechanical interlock between the airfoils and the core material. Therefore, instead of putting tension on all of the core material (by the expanding airfoil), there is compressive stress on the core material against the airfoil between the opposing flanges, forming the mechanical interlock between the core material and the airfoil. Thus, the interlocking feature firmly secures the airfoil to the core material during bi-casting of the turbine engine component, substantially preventing separation of the airfoil and core material during bi-casting. The ability to resist separation of the airfoil and core material during bi-casting results in forming the improved slip joint 206 between the outer end portions of each of the airfoils and the outer shroud ring in the bi-cast turbine engine component.

After the molten metal has solidified, the ceramic mold material 140 is removed from the outside of the airfoils and shroud rings. The core material 158 is removed by a chemical leaching process as known in the art leaving the space 262 in the shroud ring adjacent the end portions 302 or 304 of the airfoils. The improved slip joints 206 (FIGS. 7 through 11) are formed between the end portion of each of the airfoils and the adjacent shroud ring to accommodate thermal expansion and contraction of the airfoils. The slip joints allows the airfoils to slide radially relative to the slip coupled shroud ring. It is to be noted that the opposing end portion is anchored to the opposing shroud ring as previously noted and hereinafter described. In the absence of the slip joints, substantial thermal stresses would be set up in the airfoils and the inner and outer shroud rings during airfoil expansion and contraction.

Referring again to FIG. 5, it should be noted that the outer end portion of each airfoil 120 is mechanically anchored in the outer shroud ring by methods well known in the art. This arrangement prevents the airfoils 120 from moving out of engagement with the opposing shroud ring as the slip joints open. More particularly, the outer end portions of each of the airfoils 120 are anchored in and held against radial movement relative to the inner shroud ring (thereby making the outer shroud ring in this case the attachment shroud). Each of the identical airfoils 120 (FIG. 5) has a relatively wide outer end portion. Thus, the outer end portion has a flange section that extends outwardly from the leading edge portion of the airfoil. The outwardly projecting flange section provides for a mechanical interconnection between the airfoil 120 and the outer shroud ring throughout a substantial arcuate distance along the shroud ring. In addition, the outer end portion of the airfoil has a configuration to provide for a mechanical interlocking between the outer shroud ring and the outer end portion of the airfoil 120. Due to the mechanical connection between the outer end portion of the airfoil 120 and the outer shroud ring, the outer end portion 32 of each airfoil 120 is anchored and cannot move radially outwardly of the outer shroud ring. In this regard, while both airfoil end portions have been described as bi-cast with the inner and outer shroud rings, it is to be understood that one of the end portions may be bi-cast (the end portion of the airfoil that radially moves in and out of the space in the shroud ring), while the opposing end portion may be fastened by brazing, welding, or the like to the opposing shroud ring in the bi-cast turbine engine component. As noted previously, although the slip joints are illustrated in FIG. 5 as being between the inner shroud ring and the inner end portions of the airfoil 120, it is to be understood that the slip joints could be between the outer shroud ring and the outer end portions of the airfoils if desired, using the inner shroud ring instead of the outer shroud ring as the attachment shroud as previously described.

During operation of the gas turbine engine, the airfoils 120 are exposed to hot combustion gas 108 (FIG. 3) that comes directly from the combustion chamber (not shown). When the inner and outer shroud rings 104 and 105 and airfoils 120 are at the same temperature, the slip joints 206 are tightly closed, in the manner illustrated schematically in FIG. 6. However, when the airfoils 120 are heated to a temperature that is above the temperature of the inner and outer shroud rings 104 and 105, the airfoils expand radially outwardly relative to the shroud rings. The airfoils 120 become hotter than the inner and outer shroud rings 104 and 105 because the airfoil material has a higher coefficient of thermal expansion than that of the shroud material and because the airfoils are more exposed than the shroud rings to the hot combustion gas. Therefore, the airfoils tend to move radially inwardly (as shown by arrow A in FIG. 8A) relative to the shroud rings 104 and 105. Due to the fact that the airfoils 120 are heated to a higher temperature than the shroud rings 104 and 105, there will be greater thermal expansion of the airfoils 120 relative to the shroud rings. As this occurs, the slip joints open, as shown schematically in FIG. 8A.

Referring now specifically to airfoil 120*a* of FIGS. 6 through 8B, as the slip joints open, the airfoil will move radially into the space in the adjacent shroud ring. As noted previously, the opposing flanges of the end portions of the airfoils 120 move away from corresponding shaped shroud ring inner side edge portions on the inside of openings in the outer shroud ring. Therefore, upon heating of the airfoils 120 to a temperature that is above the temperature of the shroud rings, each airfoil 120 expands and moves radially inwardly relative to the inner shroud ring, opening the slip joint between the inner end portion of the airfoil and the inner shroud ring. By opening the slip joints 58 in the manner illustrated in FIG. 8A, the application of thermal stresses to the airfoils 120 is substantially avoided. The slip joints can readily move from the closed condition of FIG. 7 to the open condition of FIG. 8A under the influence of thermal expansion forces as there is no metallurgical bond between the end portion and adjacent shroud ring of the airfoil 120.

Unlike the airfoils in the conventional bi-cast turbine engine component, the airfoils 120*a* in the turbine engine component (more particularly, the bi-cast turbine nozzle) according to exemplary embodiments of the present invention can contract out of the space 262 in the adjacent shroud ring when the temperature of the shroud rings is higher than that of the airfoils. More particularly, during engine deceleration, the airfoils cool down faster than the shroud rings. Using the ductility of the airfoil material at operating temperatures, the opposing flanges of the illustrated airfoil 120*a* contract inwardly as indicated by the arrows A in FIG. 8B, thereby allowing each of the airfoils 120*a* in the annular array to move radially outwardly from the space in the shroud ring (as shown by arrow B).

Referring now specifically to the airfoils 120*b* through 120*d* partially depicted in FIGS. 9 through 11, the ductility of the airfoil material is not utilized to permit radial movement of the airfoil relative to the shroud ring as a result of thermal differential expansion and contraction. Instead, the end portion (more particularly, the opposing flanges) of the airfoils 120*b* through 120*d* is shaped to define the slip joint 206 between the opposing flanges and the adjacent shroud ring to permit radial movement of the airfoil within the space in the adjacent shroud ring. More particularly, as noted previously, the end portion maintains a radial gap to the adjacent surface of the (adjacent) shroud ring. For example, the end portion of airfoil 120*b* in FIG. 9 is shaped to define the inverted generally T-shaped end portion. The opposing flanges can move radially inwardly into the space during thermal expansion of the airfoils 120*b* and can move radially outwardly in the space until the opposing flanges abut the adjacent shroud ring. The end portion of airfoil 120*c* in FIG. 10 is also shaped to permit radial movement of the airfoil within the space in the adjacent shroud ring. The end portion of airfoil 120*d* in FIG. 11 includes side notches 121 to permit the airfoil to move radially outwardly in the space. Airfoils 120*b* through 120*b*, like airfoils 120*a*, can move radially inwardly and outwardly relative to the adjacent shroud ring as a result of thermal differential expansion and contraction.

Moreover, if there is a burn through of one of the vanes in the annular array because the portion of the vane that is exposed in the flow path reaches temperatures higher than the melting point of the airfoil material, the slip joint portion of the airfoil will be retained.

From the foregoing, it is to be appreciated that airfoils configured to form an improved slip joint in bi-cast turbine engine components and the turbine engine components including the same are provided. The airfoils are configured to form improved slip joints that permit the airfoils to thermally expand and contract during gas turbine engine operation without substantial thermal stresses and to form a mechanical interlock between the airfoils and core material that remains intact during bi-casting of the turbine engine component such that the improved slip joint may be formed.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A stationary airfoil for a bi-cast turbine engine component, the stationary airfoil comprising:

a leading edge and a trailing edge interconnected by a pressure sidewall and a suction sidewall; and an end portion shaped with a pair of inwardly deformable opposing flanges to form a slip joint with a shroud ring in the bi-cast turbine engine component, each one of the pair of inwardly deformable opposing flanges curve radially outward from a respective one of the pressure sidewall and the suction sidewall to define the end portion and to define an interlocking feature, the slip joint permitting radial movement of the stationary airfoil relative to the shroud ring due to thermal differential expansion and contraction, wherein the end portion comprises a generally C-shaped end portion, and the inwardly deformable opposing flanges define a terminal end of the end portion.

2. The stationary airfoil of claim 1, wherein the end portion is configured to be slip coupled to the shroud ring in the bi-cast turbine engine component by the slip joint, with the shroud ring being cast about the end portion.

3. The stationary airfoil of claim 2, wherein the end portion comprises one of an outer end portion slip coupled to the shroud ring comprising an outer shroud ring or an inner end portion slip coupled to the shroud ring comprising an inner shroud ring.

4. The stationary airfoil of claim 3, wherein an annular array of airfoils extends between the outer and inner shroud rings, the stationary airfoil being in the annular array of airfoils.

5. The stationary airfoil of claim 1, wherein the opposing flanges comprise a convex surface and a concave surface.

6. The stationary airfoil of claim 1, wherein the end portion of the stationary airfoil is shaped such that an outer surface of the opposing flanges slides against side edge portions of an opening in the shroud ring to permit radial movement of the stationary airfoil relative to the shroud ring.

7. The stationary airfoil of claim 1, wherein the interlocking feature of the end portion forms a mechanical interlock with a core material during manufacture of the bi-cast turbine engine component to permit formation of the slip joint between the end portion and the shroud ring in the bi-cast turbine engine component, the interlocking feature comprising the pair of opposing flanges that retain the core material during manufacture forming the mechanical interlock such that the core material remains fastened to the end portion until the core material is removed.

8. A turbine engine component comprising:

a shroud ring; and a stationary airfoil coupled to the shroud ring, the stationary airfoil comprising:

a leading edge and a trailing edge interconnected by a pressure sidewall and a suction sidewall; and an end portion forming a slip joint with the shroud ring, the slip joint permitting radial movement of the stationary airfoil relative to the shroud ring and the end portion is shaped to include a pair of inwardly deformable opposing flanges to define the slip joint, each one of the pair of inwardly deformable opposing flanges curve radially outward from a respective one of the pressure sidewall and the suction sidewall to define the end portion, wherein the end portion comprises a generally C-shaped end portion, and the inwardly deformable opposing flanges define a terminal end of the end portion.

9. The turbine engine component of claim 8, wherein the end portion is configured to be slip coupled to the shroud ring in the turbine engine component by the slip joint, the shroud ring cast about the end portion.

10. The turbine engine component of claim 9, wherein the end portion comprises a first end portion and the shroud ring comprises a first shroud ring, each stationary airfoil further comprising a second end portion coupled to an opposing second shroud ring, the second shroud ring cast about or coupled to the second end portion.

11. The turbine engine component of claim 10, wherein each stationary airfoil is in an annular array of airfoils extending between the first shroud ring and the second shroud ring.

12. The turbine engine component of claim 8, wherein the opposing flanges of the end portion slide against side edge portions of an opening in the shroud ring to permit radial movement of the stationary airfoil relative to the shroud ring.

13. The turbine engine component of claim 8, wherein the turbine engine component comprises a turbine nozzle selected from the group consisting of a bi-cast turbine nozzle, a unitary full shroud ring turbine nozzle, and a segmented turbine nozzle assembly.

14. The turbine engine component of claim 8, wherein the pair of inwardly deformable opposing flanges expand into and contract out of a space in the shroud ring adjacent to the end portion to permit the radial movement of the stationary airfoil relative to the shroud ring.

15. A bi-cast turbine engine component comprising:

an outer shroud ring;

an inner shroud ring circumscribed by the outer shroud ring and spaced therefrom to define a portion of a flow path in a gas turbine engine;

a plurality of stationary airfoils disposed in an annular array between the outer and inner shroud rings and configured to be disposed in the portion of the flow path, each stationary airfoil comprising:

a leading edge and a trailing edge interconnected by a pressure sidewall and a suction sidewall; and an end portion forming a slip joint with a shroud ring comprising one of the outer or inner shroud rings, the end portion disposed in a space in the shroud ring adjacent to the end portion of the stationary airfoil and shaped with a pair of inwardly deformable opposing flanges, each one of the pair of inwardly deformable opposing flanges curve radially outward from a respective one of the pressure sidewall and the suction sidewall to define a terminal end of the end portion and each stationary airfoil moving radially relative to the shroud ring due to thermal differential expansion and contraction, wherein the end portion comprises a generally C-shaped end portion.

16. The bi-cast turbine engine component of claim 15, wherein the pair of inwardly deformable opposing flanges expand into and contract out of the space in the shroud ring adjacent to the end portion to permit the radial movement of the stationary airfoil relative to the shroud ring.

17. The bi-cast turbine engine component of claim 15, wherein the pair of inwardly deformable opposing flanges comprise a convex and a concave surface that permit the airfoil to move radially within the space in the shroud ring.

* * * * *